US009050228B2

(12) United States Patent
Lemonnier et al.

(10) Patent No.: US 9,050,228 B2
(45) Date of Patent: Jun. 9, 2015

(54) SIDERAIL LATCHING MECHANISM

(71) Applicants: Pascal Lemonnier, Locoal Mendon (FR); Philippe Legros, Pluneret (FR); Pascal Guguin, Brech (FR)

(72) Inventors: Pascal Lemonnier, Locoal Mendon (FR); Philippe Legros, Pluneret (FR); Pascal Guguin, Brech (FR)

(73) Assignee: Hill-Rom S.A.S., Pluvigner (FR)

( * ) Notice: Subject to any disclaimer, the term of this patent is extended or adjusted under 35 U.S.C. 154(b) by 0 days.

(21) Appl. No.: 13/799,583

(22) Filed: Mar. 13, 2013

(65) Prior Publication Data

US 2013/0239327 A1 Sep. 19, 2013

Related U.S. Application Data

(60) Provisional application No. 61/610,462, filed on Mar. 13, 2012.

(51) Int. Cl.
*A47C 21/08* (2006.01)
*A61G 7/05* (2006.01)

(52) U.S. Cl.
CPC ..... *A61G 7/0507* (2013.01); *A61G 2007/0509* (2013.01); *A61G 2007/0519* (2013.01)

(58) Field of Classification Search
USPC ..... 5/424, 425, 428, 430
See application file for complete search history.

(56) References Cited

U.S. PATENT DOCUMENTS

| | | | | |
|---|---|---|---|---|
| 6,519,794 | B1 * | 2/2003 | Aarestad et al. | 5/430 |
| 6,779,209 | B2 * | 8/2004 | Ganance | 5/430 |
| 7,003,824 | B2 * | 2/2006 | Roussy | 5/430 |
| 7,761,939 | B2 * | 7/2010 | Wiggins et al. | 5/430 |
| 7,793,369 | B2 * | 9/2010 | Guguin et al. | 5/425 |
| 2006/0107460 | A1 * | 5/2006 | Wiggins et al. | 5/430 |
| 2006/0137094 | A1 * | 6/2006 | Roussy | 5/425 |
| 2009/0188042 | A1 * | 7/2009 | Derenne et al. | 5/430 |
| 2011/0000019 | A1 * | 1/2011 | Ito et al. | 5/428 |
| 2011/0219541 | A1 * | 9/2011 | Jacobs et al. | 5/430 |
| 2011/0258779 | A1 * | 10/2011 | Derenne et al. | 5/600 |

* cited by examiner

*Primary Examiner* — Timothy D Collins
*Assistant Examiner* — Richard G Davis
(74) *Attorney, Agent, or Firm* — Jason Penninger

(57) ABSTRACT

A siderail assembly configured to move between a storage position and a deployed position comprises a base, a siderail body, and a movement mechanism. The a base is configured to coupled to a person support apparatus. The siderail body includes a biasing portion configured to bias the siderail body toward the storage position. The movement mechanism is coupled to the base and the siderail body and is configured to move the siderail body between the deployed position and the storage position. The movement mechanism engages the biasing portion as the movement mechanism moves the siderail body from the storage position toward the deployed position. The movement mechanism overcomes the bias of the biasing portion to move the siderail body to the deployed position.

20 Claims, 7 Drawing Sheets

SIDERAIL LATCHING MECHANISM

This application claims priority to U.S. Provisional Application Ser. No. 61/610,462 titled SIDERAIL LATCHING MECHANISM filed on Mar. 13, 2012, the contents of which are incorporated herein by reference.

BACKGROUND OF THE DISCLOSURE

This disclosure relates generally to siderail assemblies attached to person support apparatuses. More particularly, but not exclusively, one illustrative embodiment relates to a siderail assembly with a latching mechanism configured to prevent false latching conditions.

Generally, a person support apparatus can include a siderail that can be configured to move between a deployed position and a storage position. The siderail can be selectively maintained in at least one of the positions by a latching mechanism. While various siderails and latching mechanisms have been developed, there is still room for improvement. Thus a need persists for further contributions in this area of technology.

SUMMARY OF THE DISCLOSURE

In one illustrative embodiment of the present disclosure, a siderail assembly comprising a base, a panel, and a movement mechanism. The panel includes a bumper protruding there from. The movement mechanism is coupled to the base and the panel and is configured to move the panel between a deployed position and a storage position. A portion of the movement mechanism is configured to engage the bumper as the movement mechanism is moved from the storage position toward the deployed position and to deform the bumper as the movement mechanism moves the panel into the deployed position.

In another illustrative embodiment, a person support apparatus comprises a frame, a siderail base coupled to the frame, a siderail panel, a siderail movement mechanism, and a latch. The siderail panel includes a bumper protruding there from. The siderail movement mechanism is coupled to the siderail base and the siderail panel and is configured to move the siderail panel between a deployed position and a storage position with respect to the frame. A portion of the siderail movement mechanism is configured to engage the bumper as the movement mechanism is moved from the storage position toward the deployed position. The bumper resists movement of the siderail panel to the deployed position. The latch is configured to selectively maintain the siderail panel in the deployed position upon movement of the siderail panel to the deployed position.

In another illustrative embodiment, a person support apparatus comprises a frame, a siderail base coupled to the frame, a siderail panel, a siderail movement mechanism, and a latch. The siderail movement mechanism is coupled to the siderail base and the siderail panel and is configured to move the siderail panel between a deployed position and a storage position with respect to the frame. A portion of the siderail movement mechanism is configured to engage a means for resisting movement of the siderail panel to the deployed position as the movement mechanism is moved from the storage position toward the deployed position. The latch is configured to selectively maintain the siderail panel in the deployed position upon movement of the siderail panel to the deployed position.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
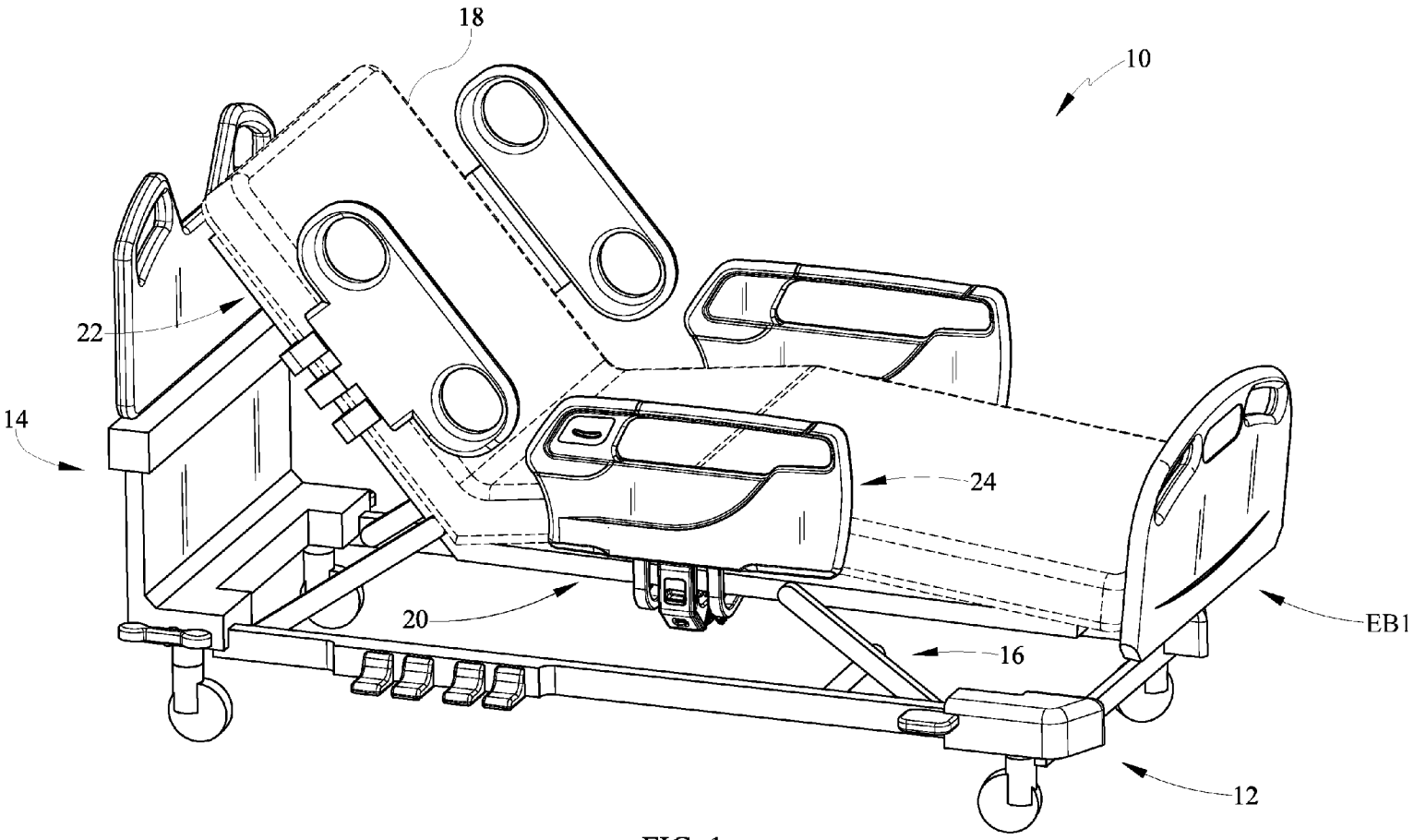
FIG. 1 is a perspective side view of a person support apparatus with a siderail assembly coupled thereto according to one illustrative embodiment of the disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

A person support apparatus 10 according to one contemplated embodiment of the current disclosure is shown in FIG. 1. The person support apparatus 10 is a hospital bed and includes a lower frame 12 or base 12, an upper frame 14, and a plurality of supports 16 that movably support the upper frame 14 above the lower frame 12. In some contemplated embodiments, the person support apparatus 10 can also be a hospital stretcher, an operating table, or other apparatus configured to support a person thereon. Also in some contemplated embodiments, the person support apparatus 10 supports a person support surface 18 or mattress 18 on the upper frame 14. The supports 16 are lift mechanisms configured to raise and lower the upper frame 14 with respect to the lower frame 12. In some contemplated embodiments, the supports 16 can move the upper frame 14 between a Trendelenburg and reverse Trendelenburg orientation.

The upper frame 14 includes an upper frame base 20 and a deck 22 and has siderail assemblies 24 and endboards EB1 coupled thereto as shown in FIG. 1. The upper frame base 20 is movably coupled to the supports 16 and supports the deck 22. The deck 22 includes multiple sections configured to pivot and/or translate with respect to the upper frame base 20 and one another to move an occupant supported thereon between various configurations, including, but not limited to, supine, reclined, raised head and torso, and chair.

The siderail assemblies 24 include a base 26, a movement assembly 28, and a panel 30 or siderail body 30, as shown in FIGS. 1-3 and 6-7, that are configured to move the siderail body 30 between a raised or deployed position, where a majority of the siderail body 30 extends above the deck 22, and a lowered or storage position, where a majority of the siderail body 30 is below the deck 22. The base 26 includes a coupling portion CP1 and a latching portion LP1. The coupling portion CP1 is configured to couple the movement assembly 28 and siderail body 30 to the upper frame 14. In some contemplated embodiments, the coupling portion CP1 is coupled to the upper frame base 20. It other contemplated embodiments, the coupling portion CP1 is coupled to one of the sections of the deck 22. The latching portion LP1 is configured to engage a portion of the movement assembly 28 to maintain the siderail body 30 in at least one of the deployed position and the storage position. The latching portion includes a pin guide PG1 and a slot PS1. The pin guide PG1 is an angled surface that guides a portion of the movement assembly 28 engaging the surface toward the slot PS1 as the siderail body 30 is moved from the storage position to the deployed position. The slot PS1 is configured to receive and removably retain a portion of the movement assembly 28 to maintain the siderail body 30 in the deployed position.

The movement assembly 28 is movably coupled to the base 26 and the siderail body 30 and is configured to selectively move the siderail body 30 between the deployed position and the storage position. The movement assembly 28 includes a pair of link arms 32 and a latch mechanism 34 as shown in FIGS. 1-8. In some contemplated embodiments, the movement assembly 28 also includes a dampener SD, such as, a spring dampener, coupled to the base 26 and the latch mechanism 34 and configured to slow the movement of the siderail body 30 as the siderail body 30 is moved between the deployed position and the storage position. The link arms 32 are movably coupled to the base 26 at a first pivot P1 and movably coupled to the siderail body 30 at a second pivot P2.

Figure 8:
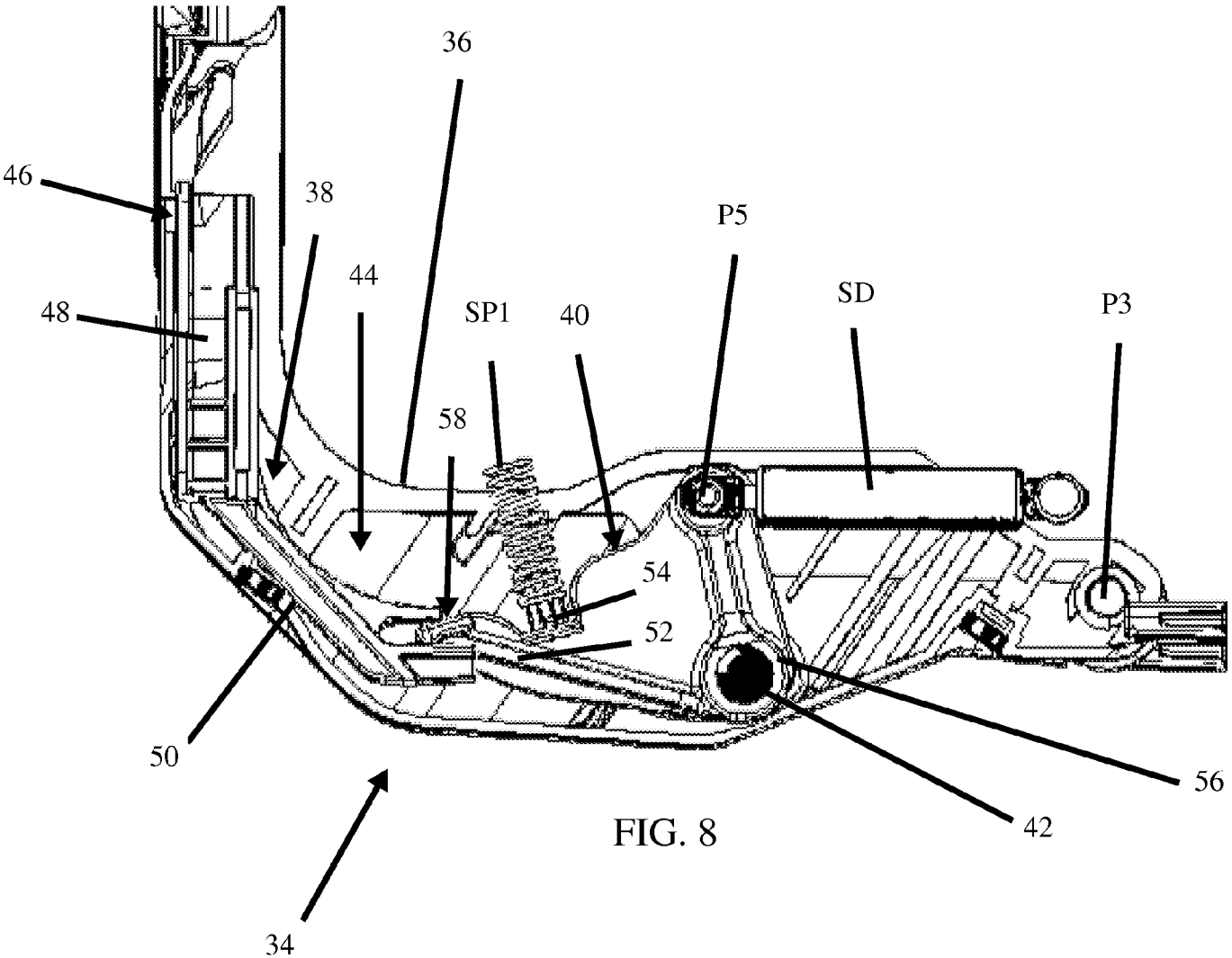
FIG. 8 is a cross-sectional side view of the latch mechanism of FIG. 2 showing the housing, the handle, the link, the pin, and the spring engaging the link.

The latch mechanism 34 is configured to cooperate with the base 26 to selectively prevent the link arms 32 and the latch mechanism 34 from moving with respect to the upper frame 14 to maintain the siderail body 30 in the deployed position. The latch mechanism 34 includes a housing 36, a handle 38, a link 40, and a pin 42 as shown in FIG. 8. The housing 36 is movably coupled to the base 26 at a third pivot P3 and movably coupled to the siderail body 30 at a fourth pivot P4. The housing 36 includes an inner space 44, an opening 46 into the inner space 44, and a slot HS 1.

Figure 2:
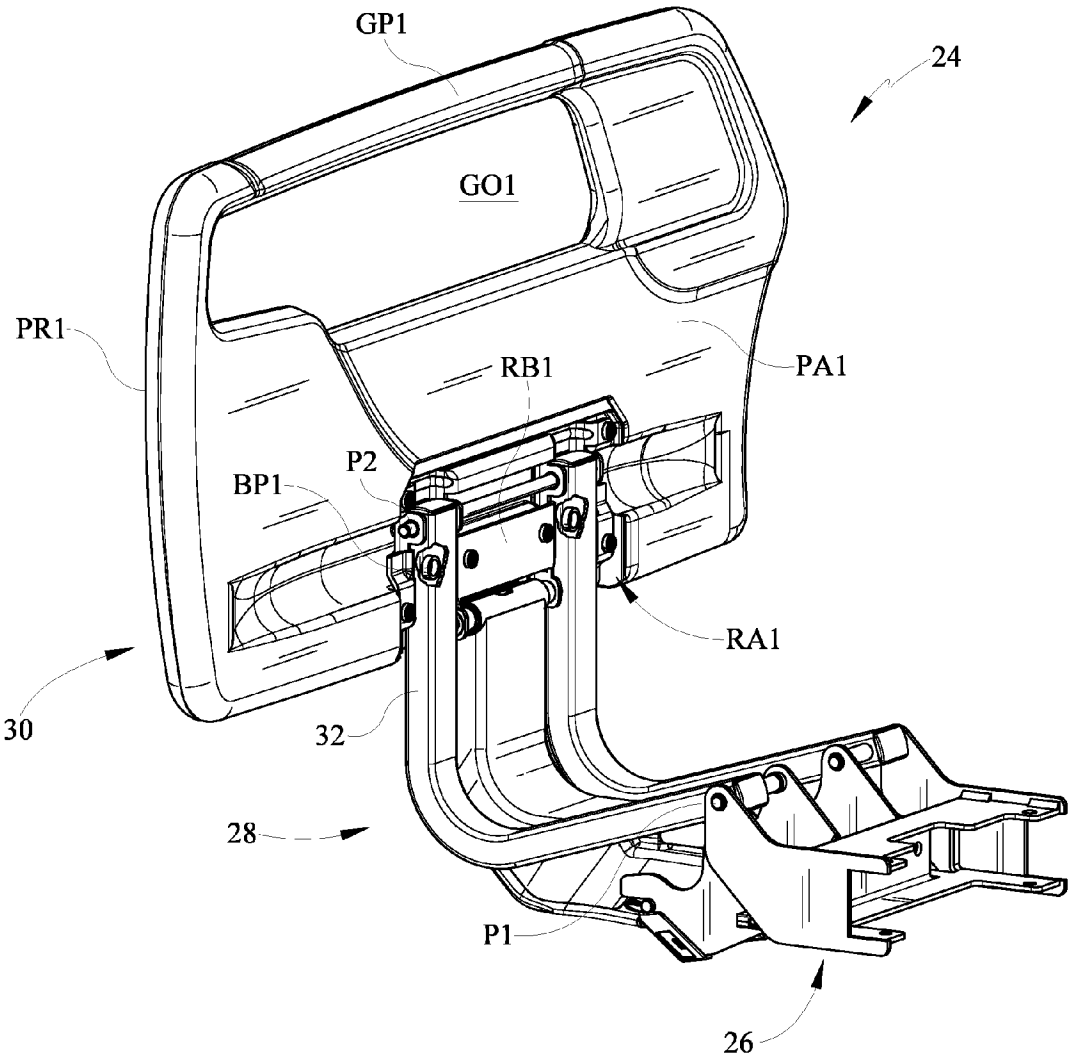
FIG. 2 is a perspective side view of the siderail assembly of FIG. 1 showing the siderail body, the movement mechanism, and the siderail base.
Figure 3:
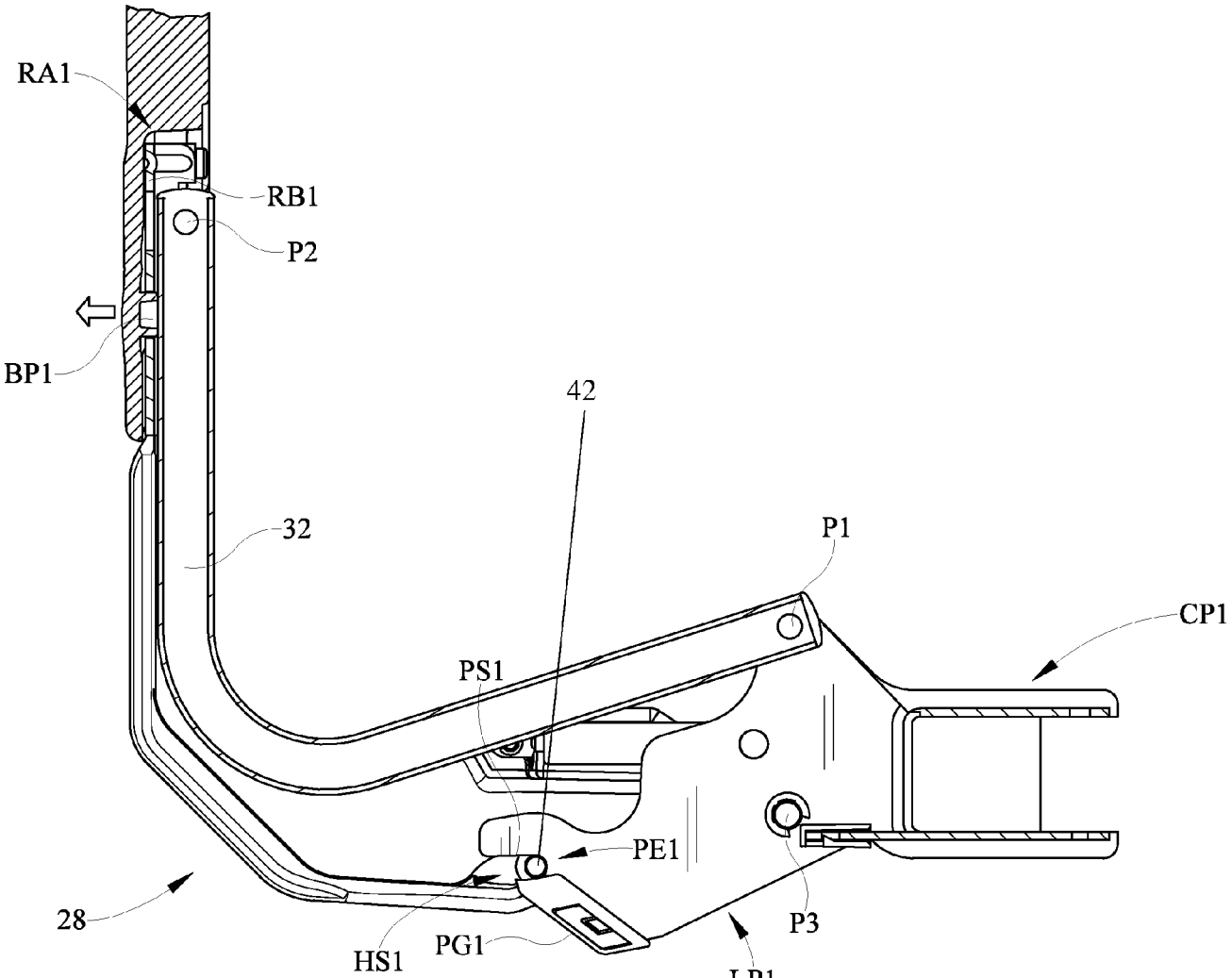
FIG. 3 is a partial cross-sectional side view of the siderail assembly of FIG. 2 showing the siderail panel in the deployed position with the pin in the slot.
Figure 5:
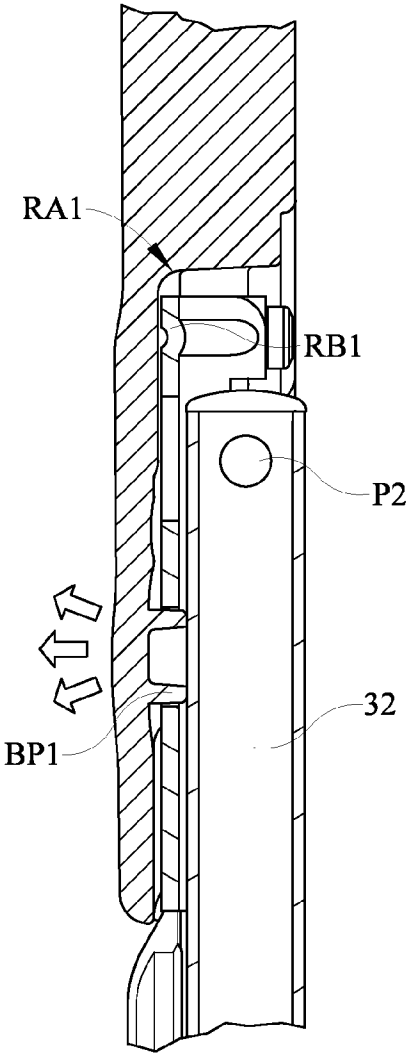
FIG. 5 is a partial cross-sectional side view of the siderail panel of FIG. 2 with the link arm pressing against the bumper to bend a portion of the siderail panel when the siderail panel is in the deployed position.
Figure 4:
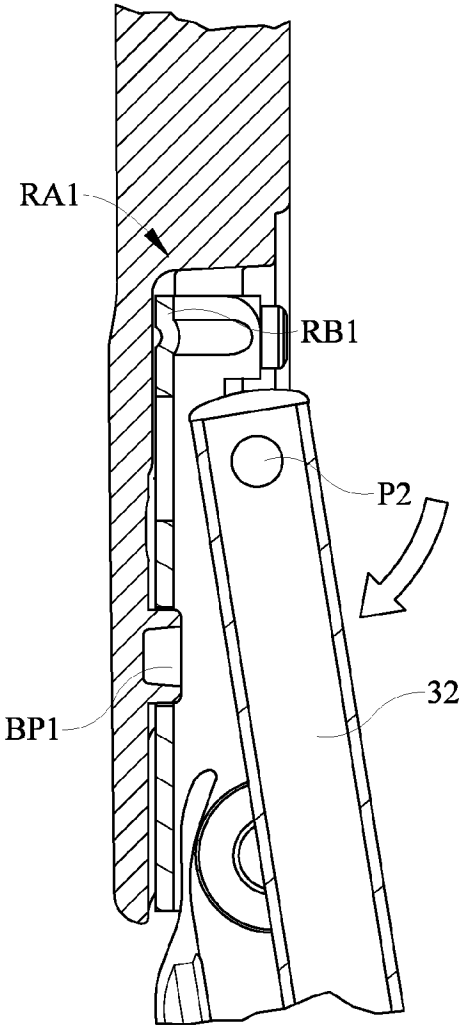
FIG. 4 is a partial cross-sectional side view of the siderail panel of FIG. 2 with the link arm moving toward the bumper as the siderail panel is moved from the storage position toward the deployed position.
Figure 6:
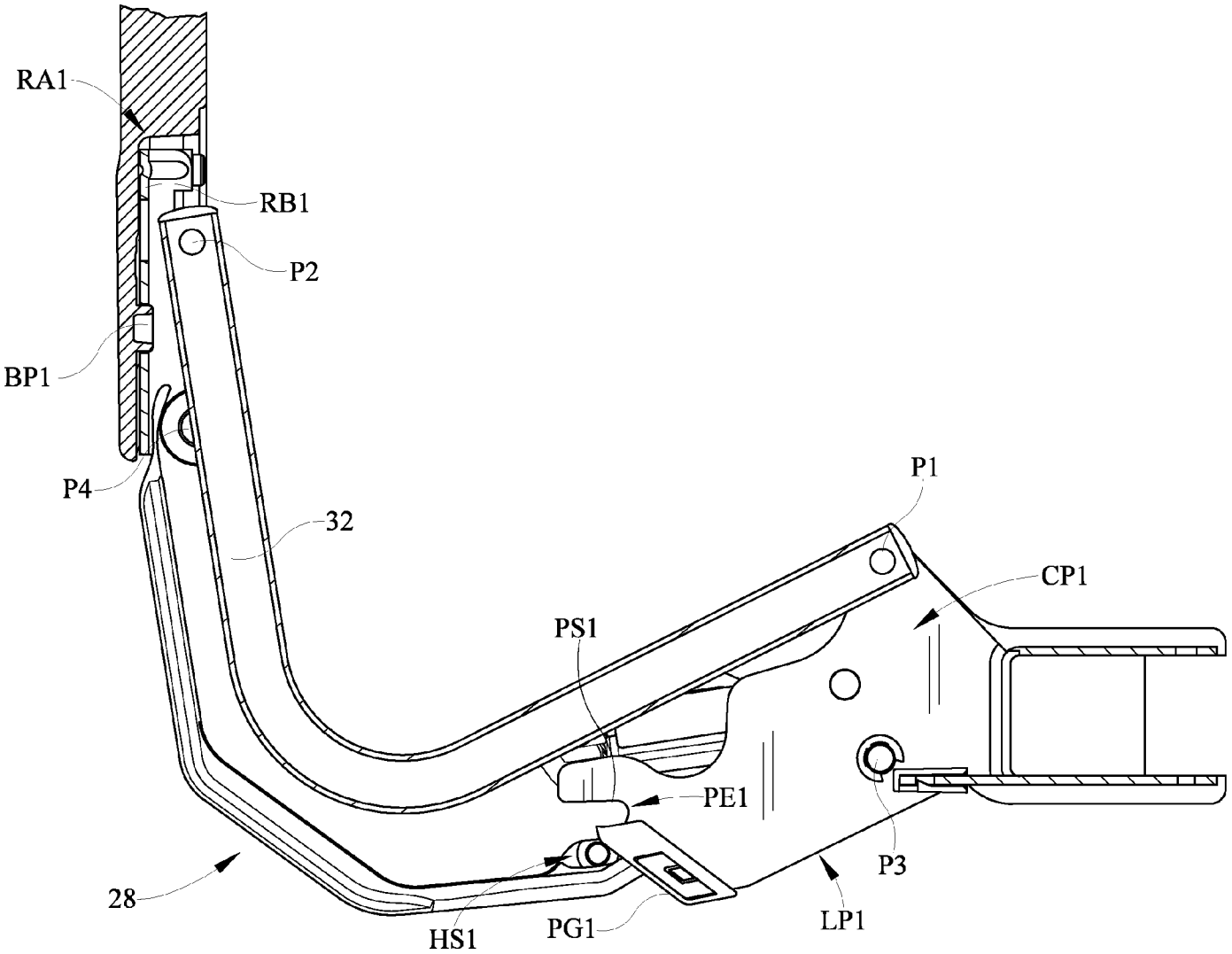
FIG. 6 is a partial cross-sectional side view of the siderail assembly of FIG. 2 with the pin moving along the ramp as the siderail assembly moves from the storage position to the deployed position.
Figure 7:
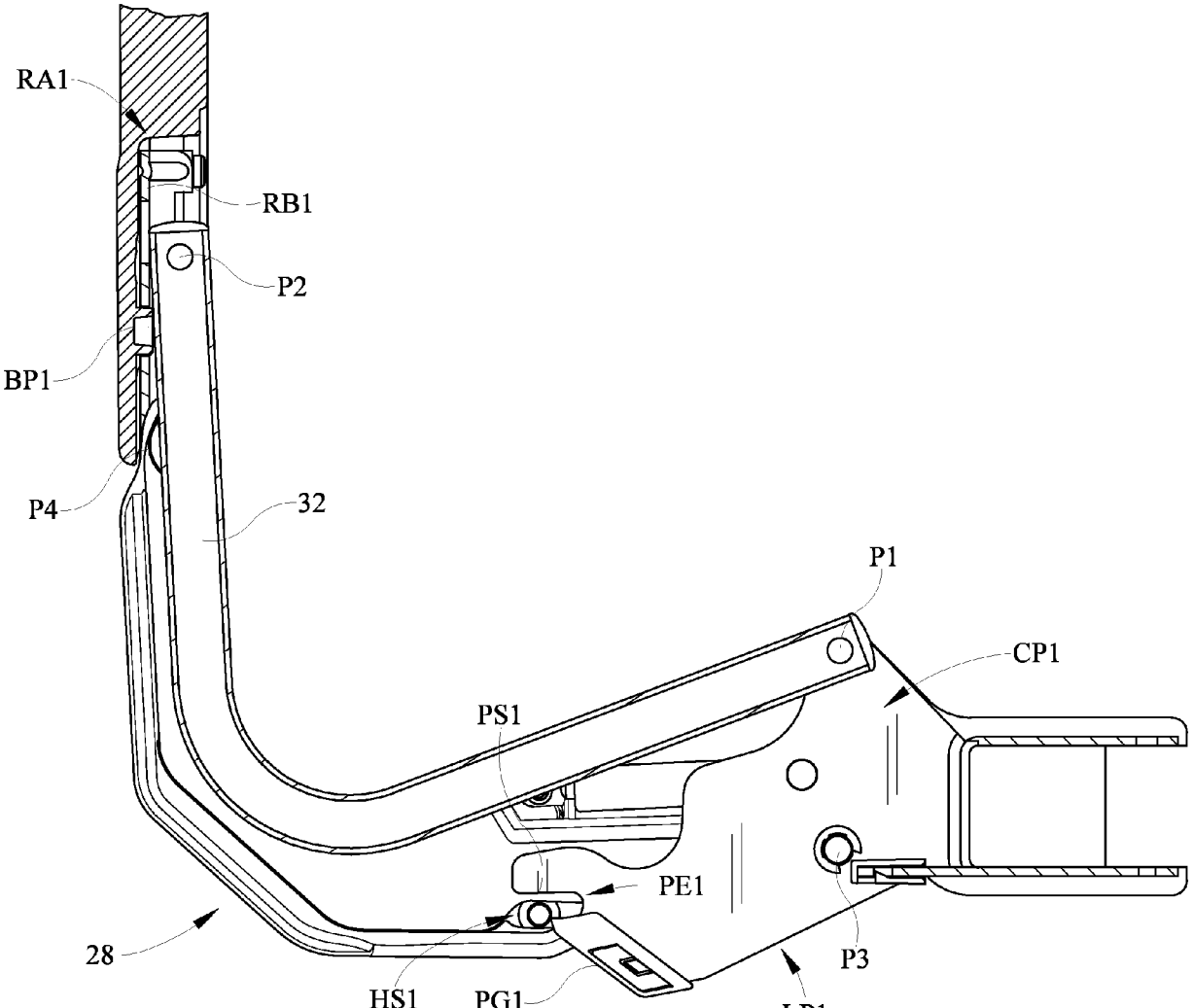
FIG. 7 is a partial cross-sectional side view of the siderail assembly of FIG. 2 with the pin at the edge of the slot and the link arms engaging the bumpers.

The handle 38 is positioned in the inner space 44 proximate to the opening 46 and includes a grip 48 and an extension member 50 as shown in FIGS. 2-3. The grip 48 is accessed via the opening 46 and the extension member 50 extends from the grip 48 and is coupled to the link 40. The handle 38 is configured to be moved between a first position or latched position and a second position or unlatched position with respect to the housing 36. The handle 38 is in the first position when the siderail body 30 is maintained in the deployed position, and when the siderail body 30 is in the storage position. The handle 38 is moved to the second position when a user grips the pulls up on the handle 38, causing the link 40 to pivot and remove the pin 42 from the slot PS1 in the base 26, which allows the movement assembly 28 and the siderail body 30 to move with respect to the upper frame 14.

The link 40 is movably coupled to the extension member 50 and is rotatably coupled to the housing 36 at a link pivot P5 as shown in FIG. 8. The link 40 includes a first portion 52, a second portion 54, and a third portion 56. The first portion 52 engages the extension member 50 at a joint 58. The second portion 54 engages a spring SP1 positioned between the housing 36 and the link 40 that is configured to bias the link 40 so that the link 40 pushes the pin 42 into the slot PS1 when the siderail body 30 is in the deployed position. The third portion 56 is coupled to the pin 42, which is configured to extend through the slot HS 1 in the housing 36 to engage the pin engaging portion PE1 and the slot PS1.

The siderail body 30 includes a panel PA1 with a perimeter edge PR1, a coupling area RA1, and a grip opening GO1 that passes through the panel PA1 and cooperates with the perimeter edge PR1 to define a grip GP1 as shown in FIGS. 2-7. The coupling area RA1 includes bracket RB 1 secured thereto that is configured to pivotably couple the link arms 32 and latch mechanism 34 to the siderail body 30. The coupling area RA1 also includes a pair of bumpers BP1 protruding there from that are configured to be engaged by the link arms 32 to help prevent a false latching condition.

A false latching condition can occur when an external force is applied to a siderail, i.e., a person leaning on the siderail that appears to be maintained in the deployed position, and the external force causes the assembly maintaining the siderail in the deployed position to disengage and allow the siderail to move from the deployed position to the storage position. In one illustrative embodiment, a false latch condition might occur if the pin 42 is able to be positioned on the edge of the slot PS1. False latching conditions can be prevented by fully latching the assembly maintaining the siderail in the deployed position. In one illustrative embodiment, the latch mechanism 34 can be fully latched when the pin 42 substantially engages the slot PS1 as shown in FIG. 3. In some instances, an audible "click" can be heard when the latch mechanism 34 is fully latched, which can result from the pin 42 contacting the base of the slot PS1.

The bumpers BP1 help prevent false latching conditions by resisting movement of the siderail body 30 to the deployed position and biasing the siderail body 30 toward the storage position. In order for the siderail body to be moved to the deployed position, the movement assembly 28 must engage the bumpers BP1 and exert a force sufficient to deform the bumpers BP1. In some contemplated embodiments, the coupling area RA1 is composed of a resilient material and the force exerted on the bumpers BP1 causes a portion of the coupling area RA1 to flex. In other contemplated embodiments, the bumpers BP1 can be composed of a resilient material, such as, for example, rubber, and the force exerted on the bumpers BP1 by the movement assembly 28 causes the bumpers BP1 to deform. In other contemplated embodiments, the bumpers BP1 are constructed to be compressed from a first position to a second position by the movement assembly 28 when the siderail body 30 is raised to the deployed position, and expand from the second position to the first position when the siderail body 30 is moved from the deployed position toward the storage position. In still other contemplated embodiments, the bumpers BP1 are constructed of other resilient structures coupled to the siderail body 30. If the user attempting to position the siderail body 30 in the deployed position does not exert enough force to sufficiently deform the bumpers BP1, the pin 42 will not engage the slot PS1 and the siderail body 30 will not be maintained in the deployed position and will move back toward the storage position.

In operation, the siderail body 30 can be initially positioned in the stored position. As the siderail body 30 is moved from the storage position toward the deployed position, the pin 42 engages the pin guide PG1. As the pin 42 travels along the pin guide PG1, the link 40 is pivoted about the link pivot P5 and compresses the spring SP1. Once the pin 42 reaches the top of the pin guide PG1, the link arms 32 begin to engage the bumpers BP1. As the bumpers BP1 are deformed, the pin 42 begins to move over the edge between the slot PS1 and the pin guide PG1. Once the bumpers BP1 are sufficiently deformed and the siderail body 30 is in the deployed position, the pin 42 is pushed into the slot PS1 by the spring SP1 to latch the siderail assembly 24 and maintain the siderail body 30 in the deployed position.

Many other embodiments of the present disclosure are also envisioned. For example, a siderail assembly comprising a base, a panel, and a movement mechanism. The panel includes a bumper protruding there from. The movement mechanism is coupled to the base and the panel and is configured to move the panel between a deployed position and a storage position. A portion of the movement mechanism is configured to engage the bumper as the movement mechanism is moved from the storage position toward the deployed position and to deform the bumper as the movement mechanism moves the panel into the deployed position.

In another example, a person support apparatus comprises a frame, a siderail base coupled to the frame, a siderail panel, a siderail movement mechanism, and a latch. The siderail panel includes a bumper protruding there from. The siderail movement mechanism is coupled to the siderail base and the siderail panel and is configured to move the siderail panel between a deployed position and a storage position with respect to the frame. A portion of the siderail movement mechanism is configured to engage the bumper as the movement mechanism is moved from the storage position toward the deployed position. The bumper resists movement of the siderail panel to the deployed position. The latch is configured to selectively maintain the siderail panel in the deployed position upon movement of the siderail panel to the deployed position.

In another example, a person support apparatus comprises a frame, a siderail base coupled to the frame, a siderail panel, a siderail movement mechanism, and a latch. The siderail movement mechanism is coupled to the siderail base and the siderail panel and is configured to move the siderail panel between a deployed position and a storage position with respect to the frame. A portion of the siderail movement mechanism is configured to engage a means for resisting movement of the siderail panel to the deployed position as the movement mechanism is moved from the storage position toward the deployed position. The latch is configured to selectively maintain the siderail panel in the deployed position upon movement of the siderail panel to the deployed position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A siderail assembly configured to move between a storage position and a deployed position, comprising:

a siderail base configured to be coupled to a person support apparatus;

a siderail body including a biasing element configured to bias the siderail assembly toward the storage position; and a movement mechanism movably coupled to the base and the siderail body and configured to move the siderail body between the deployed position and the storage position, the movement mechanism engaging the biasing portion as the movement mechanism moves the siderail body between the storage position and the deployed position, wherein the movement mechanism overcomes the bias of the biasing portion to move the siderail body to the deployed position, the movement mechanism including a latch assembly configured to selectively engage the base to maintain the siderail body in the deployed position.

2. The siderail assembly of claim 1, wherein the biasing element includes a bumper protruding from a surface of the siderail body configured to selectively engage the movement mechanism.

3. The siderail assembly of claim 2, wherein the bumper is deformed as the movement mechanism moves the siderail body to the deployed position.

4. The siderail assembly of claim 1, wherein the biasing element is bent as the movement mechanism moves the siderail body to the deployed position.

5. The siderail assembly of claim 1, wherein the biasing element is composed of a resilient material.

6. The siderail assembly of claim 1, wherein the latch assembly includes a pin biased to engage a slot in the base to maintain the siderail body in the deployed position.

7. The siderail assembly of claim 1, wherein the latch assembly includes a pin configured to move along a pin guide as the siderail body is moved toward the deployed position.

8. The siderail of claim 1, wherein the movement mechanism includes a housing, a link pivotably coupled within the housing, and a pin extending from the link that is configured to engage a slot in the base to maintain the siderail body in the deployed position.

9. The siderail assembly of claim 1, wherein the bumper is composed of an elastic polymer.

10. A siderail assembly, comprising:

a siderail base configured to be coupled to a person support apparatus;

a siderail panel;

a siderail movement mechanism movably coupled to the siderail base and the siderail panel and configured to move the siderail panel between a deployed position and a storage position with respect to the frame, a portion of the siderail movement mechanism is configured to engage a portion of the siderail panel defining a means for biasing the siderail assembly toward the storage position as the siderail movement mechanism moves the siderail panel between the storage position and the deployed position, the siderail movement mechanism overcoming the means for biasing the siderail panel to move the siderail panel to the deployed position, the siderail movement mechanism includes a latch assembly configured to selectively engage the siderail base to maintain the siderail panel in the deployed position.

11. The siderail assembly of claim 10, wherein the means for biasing the siderail assembly toward the storage position includes a bumper protruding from a surface of the siderail panel configured to selectively engage the selectively engage the movement mechanism.

12. The siderail assembly of claim 11, wherein the bumper is deformed as the siderail movement mechanism moves the siderail panel to the deployed position.

13. The siderail assembly of claim 10, wherein the means for biasing the siderail panel toward the storage position is bent as the siderail movement mechanism moves the siderail panel to the deployed position.

14. The siderail assembly of claim 10, wherein the means for biasing the siderail panel toward the storage position is composed of a resilient material.

15. The siderail assembly of claim 10, wherein the latch assembly includes a pin biased to engage a slot in the siderail base to maintain the siderail panel in the deployed position.

16. The siderail assembly of claim 10, wherein the latch assembly includes a pin configured to move along a pin guide as the siderail panel is moved toward the deployed position.

17. The siderail of claim 10, wherein the movement mechanism includes a housing, a link pivotably coupled within the housing, and a pin extending from the link that is configured to engage a slot in the siderail base to maintain the siderail panel in the deployed position.

18. The siderail assembly of claim 10, wherein the means for biasing the siderail panel toward the storage position is composed of an elastic polymer.

19. A siderail assembly configured to move between a storage position and a deployed position, comprising:

a siderail base configured to be coupled to a person support apparatus;

a siderail body including panel, a portion of the panel defining a biasing element configured to bias the siderail body toward the storage position;

a movement mechanism rotatably coupled to the base and the siderail body and configured to move the siderail body between the deployed position and the storage position, the movement mechanism engaging the biasing portion as the movement mechanism moves the siderail body from the storage position toward the deployed position, wherein the movement mechanism overcomes the bias of the biasing portion to move the siderail body to the deployed position; and a latch assembly including a portion configured to selectively engage the base to maintain the siderail body in the deployed position.

20. The siderail assembly of claim 19, wherein the latch assembly includes a locking element and a second biasing element configured to bias the locking element toward a first position where the siderail body is maintained in the deployed position.

* * * * *